US008820350B2

(12) United States Patent
Kim et al.

(10) Patent No.: US 8,820,350 B2
(45) Date of Patent: Sep. 2, 2014

(54) FUEL PUMP MODULE

(75) Inventors: Joonseup Kim, Daejeon (KR); Wookeun Lee, Daejeon (KR)

(73) Assignee: Coavis, Chungcheongnam-do (KR)

( * ) Notice: Subject to any disclaimer, the term of this patent is extended or adjusted under 35 U.S.C. 154(b) by 62 days.

(21) Appl. No.: 13/542,305

(22) Filed: Jul. 5, 2012

(65) Prior Publication Data

US 2013/0048119 A1 Feb. 28, 2013

(30) Foreign Application Priority Data

Aug. 30, 2011 (KR) ..... 10-2011-0086807

(51) Int. Cl.

| | |
|---|---|
| ***F04F 5/00*** | (2006.01) |
| ***F02M 37/00*** | (2006.01) |
| ***F02M 37/02*** | (2006.01) |
| ***F02M 37/10*** | (2006.01) |

(52) U.S. Cl.

CPC ..... *F02M 37/0094* (2013.01); *F02M 37/025* (2013.01); *F02M 37/106* (2013.01)

USPC ..... 137/565.22; 137/565.34; 123/509; 123/514

(58) Field of Classification Search

CPC ..... B01F 5/0418; B01F 3/02; B01F 5/0421; B01F 5/0428

USPC ..... 123/509–516; 137/565.22, 565.34

See application file for complete search history.

(56) References Cited

U.S. PATENT DOCUMENTS

| | | | | |
|---|---|---|---|---|
| 6,505,644 | B2 * | 1/2003 | Coha et al. | 137/565.22 |
| 7,080,632 | B2 * | 7/2006 | Kleppner et al. | 123/509 |
| 8,465,264 | B2 * | 6/2013 | Sampson et al. | 417/176 |
| 2005/0064255 | A1 * | 3/2005 | Blaszczyk et al. | 429/19 |

FOREIGN PATENT DOCUMENTS

| | | | |
|---|---|---|---|
| KR | 101016939 | B1 | 2/2011 |

* cited by examiner

*Primary Examiner* — Craig Schneider
*Assistant Examiner* — Angelisa Hicks
(74) *Attorney, Agent, or Firm* — The Webb Law Firm

(57) ABSTRACT

Provided is a fuel pump module in which a portion of fuel transmitted from a fuel pump provided in a reservoir or fuel returned from an engine is supplied to a first jet and a second jet and a portion of the fuel is supplied from a first jet tower to a second jet tower through a connection tube connecting the first jet tower and the second jet tower to each other when the returned fuel passes through the first jet and the second jet and is then jetted to each of the first jet tower and the second jet tower to fill an inner portion of the second jet tower with the fuel, such that the fuel in a second space part of a fuel tank is rapidly transmitted, thereby making it possible to stably supply the fuel to the engine.

2 Claims, 9 Drawing Sheets

FUEL PUMP MODULE

CROSS-REFERENCE TO RELATED APPLICATIONS

This application claims priority under 35 U.S.C. §119 to Korean Patent Application No. 10-2011-0086807, filed on Aug. 30, 2011 in the Korean Intellectual Property Office, the disclosure of which is incorporated herein by reference in its entirety.

TECHNICAL FIELD

The following disclosure relates to a fuel pump module, and more particularly, to a fuel pump module in which a portion of fuel transmitted from a fuel pump provided in a reservoir or fuel returned from an engine is supplied to a first jet and a second jet and a portion of the fuel is supplied from a first jet tower to a second jet tower through a connection tube connecting the first jet tower and the second jet tower to each other when the returned fuel passes through the first jet and the second jet and is then jetted to each of the first jet tower and the second jet tower to fill an inner portion of the second jet tower with the fuel, such that the fuel in a second space part of a fuel tank is rapidly transmitted, thereby making it possible to stably supply the fuel to the engine.

BACKGROUND

Generally, a fuel supply apparatus of a vehicle, which is an apparatus transferring required fuel to an engine, includes a fuel tank storing the fuel therein and a fuel pump module supplying the fuel in the fuel tank to the engine or a fuel injection apparatus and is configured so that fuel remaining after being used in the engine is returned to the fuel pump module or an inner portion of the fuel tank.

Here, the fuel tank may be formed in a saddle type in which a central portion of a lower portion thereof is inwardly concave in order to secure a space due to a configuration of a connection shaft connecting an engine and a rear wheel shaft to each other in the case of a four-wheel driving vehicle.

Further, in the case in which a fuel pump module mounted in the saddle type of fuel tank is used, since a space of the fuel tank is divided from a specific height or less, the fuel pump module should be configured so that all fuel in the divided space may be transmitted to the engine.

As shown in FIG. 1, the fuel pump module 10 for the saddle type of fuel tank as described above is configured to include a flange assembly 20 mounted on a first space part 51 of the saddle type of fuel tank 50 in which the first space part 51 and a second space part 52 are formed and a reservoir body assembly 40 connected to a lower portion of the flange assembly 20 by a guide rod 30, wherein the reservoir body assembly 40 includes a reservoir body 41 having a hollow part 41*a* formed in a lower surface thereof so that fuel is introduced; a fuel pump 42 sucking fuel in the reservoir body 41 to transmit the fuel to an engine 60; a first jet pump 43 formed so that fuel in the first space part 51 of the fuel tank 50 is sucked through the hollow part 41*a* while a portion of fuel that is not transmitted to the engine 60 or returned fuel passing through the engine moves; a diffuser type of first guide tube 45 standing in a direction perpendicular to the reservoir body 41 to transmit the fuel passing through the first jet pump 43 or the fuel sucked through the hollow part 41*a* into the reservoir body 41; a second jet pump 44 formed so that fuel in the second space part 52 of the fuel tank 50 is sucked through a transfer line 48 while the fuel passing through the first jet pump 43 moves; a diffuser type of second guide tube 46 standing in the direction perpendicular to the reservoir body 41 to transmit the fuel passing through the second jet pump 44 or the fuel sucked through the transfer line 48 into the reservoir body 41; and a guide part 47 formed to face the second guide tube 46 at an upper portion of the second guide tube 46 to guide the fuel discharged from the second guide tube 46 to the second guide tube 46.

As described above, the fuel pump module 10 is mounted with the first space part 51, the transfer line is connected to a lower portion of the second guide tube 46 to suck the fluid in the second space part 52, and the fuel in the first space part 51 and the second space part 52 is simultaneously sucked while the fuel passes through the first jet pump 43 and the second jet pump 44, such that the fuel is filled in the reservoir body 41, thereby making it possible to transmit the fuel to the engine through the fuel pump 42.

The fuel pump module 10 is configured so that it has the transfer line 48 connected thereto, thereby making it possible to simultaneously suck the fuel received in the first space part 51 and the second space part 52 of the saddle type of fuel tank 50. However, in a state in which the fuel is present at a specific height or less of the fuel tank 50 and an operation of the fuel pump 42 stops, the fuel in the reservoir body 41 is discharged toward the fuel tank 50, such that air rather than the fuel is filled in the second guide tube 46.

In this case, when the fuel pump 42 operates, the fuel pump 42 first sucks the fuel in the first space part 51 of the fuel tank in which the fuel pump module 10 is mounted and may suck the fuel in the second space part 52 together with the fuel in the first space part 51 only after the fuel is filled in the second guide tube 46 after the passage of a predetermined time.

That is, the fuel in the first space part 51 is first sucked and used, and the fuel in the second space part 52 remains, such that the fuel in the second space part 52 may not be used.

In order to solve this phenomenon, the fuel jetted from the second jet pump 44 has been introduced into the second guide tube 46 by the guide part 47 formed at the upper portion of the second guide tube 46. However, an amount of introduced fuel is small, such that the fuel in the second space part 52 of the fuel tank 50 may not be rapidly transmitted.

Therefore, the fuel in the first space part and the second space part of the fuel tank may not be appropriately sucked, such that the fuel may not be stably supplied.

RELATED ART DOCUMENT

Patent Document (Patent Document 1) KR 10-1016939 B1 (Feb. 16, 2011) FIG. 7

SUMMARY

An embodiment of the present invention is directed to providing a fuel pump module that is mounted in a first space part of a fuel tank in which the first space part and a second space part are formed and is in communication with a suction tube in the second space part, in which a portion of fuel transmitted from a fuel pump provided in a reservoir or fuel returned from an engine is supplied to a first jet and a second jet and a portion of the fuel is supplied from a first jet tower to a second jet tower through a connection tube connecting the first jet tower and the second jet tower to each other when the returned fuel passes through the first jet and the second jet and is then jetted to each of the first jet tower and the second jet tower to fill an inner portion of the second jet tower with the fuel, such that the fuel in the second space part of the fuel tank is rapidly transmitted, thereby making it possible to stably supply the fuel to the engine.

In one general aspect, a fuel pump module includes: a flange assembly 100 mounted on a first space part 2100 of a fuel tank 2000 in which the first space part 2100 and a second space part 2200 are formed; and a reservoir body assembly 300 connected to a lower portion of the flange assembly 100, wherein the reservoir body assembly 300 includes: a reservoir body 310 having an introduction part 311 formed in a lower surface thereof so that fuel is introduced; a fuel pump 320 sucking the fuel in the reservoir body 310 to transmit the fuel to an engine 3000; a first jet 330 receiving a portion of the fuel transmitted from the fuel pump 320 or fuel returned from the engine 3000 to jet the received fuel upwardly and formed so that the fuel in the first space part 2100 of the fuel tank 2000 is sucked through the introduction part 311; a first jet tower 350 provided in the reservoir body 310, formed at an upper portion of the first jet 330, and communicating with the introduction part 311 to transmit the sucked fuel into the reservoir body 310; a second jet 340 receiving the returned fuel to jet the received fuel upwardly and formed so that the fuel in the second space part 2200 of the fuel tank 2000 is sucked through the suction tube 380; a second jet tower 360 provided in the reservoir body 310, formed at an upper portion of the second jet 340, and communicating with the suction tube 380 to transmit the sucked fuel into the reservoir body 310; and a connection tube 370 having both ends coupled to the first jet tower 350 and the second jet tower 360 to allow the first jet tower 350 and the second jet tower 360 to be in communication with each other to allow a portion of the fuel passing through the first jet tower 350 to be supplied to the second jet tower 360, such that the fuel is filled in the second jet tower to allow the fuel in the second space part of the fuel tank to be rapidly supplied, thereby making it possible to stably supply the fuel to the engine 3000.

Each of the first jet tower 350 and the second jet tower 360 may have a lower portion formed of straight pipe parts 351 and 361 and an upper portion formed of diffuser parts 352 and 362, and the connection tube 370 may be coupled to lower portions of the diffuser parts 352 and 362 to allow the diffuser parts 352 and 362 to be in communication with each other, thereby making it possible to efficiently suck the fuel in the fuel tank 2000 while more rapidly filling the fuel in the second jet tower 360.

One side of the connection tube 370 may be formed in a tapered shape or a round shape, such that a portion of the fuel passing through the first jet tower 350 is easily introduced into the second jet tower 360, thereby making it possible to more rapidly fill the fuel in the second jet tower 360.

| [Detailed Description of Main Elements] | |
|---|---|
| 1000: Fuel pump module (according to the present invention) | |
| 100: Flange assembly | |
| 200: Guide rod | |
| 300: Reservoir body assembly | |
| 310: Reservoir Body | 311: Introduction part |
| 320: Fuel pump | 321: Suction part |
| 322: Supply line | 323: Return line |
| 330: First jet | 340: Second jet |
| 350: First jet tower | |
| 351: Straight pipe part | 352: Diffuser part |
| 360: Section jet tower | |
| 361: Straight pipe part | 362: Diffuser part |
| 370: Connection tube | 380: Suction tube |
| 2000: Fuel tank | |
| 2100: First Space part | 2200: Second space part |
| 3000: Engine | |

DETAILED DESCRIPTION OF EMBODIMENTS

Hereinafter, a fuel pump module according to an exemplary embodiment of the present invention as described above will be described in detail with reference to the accompanying drawings.

Figure 1:
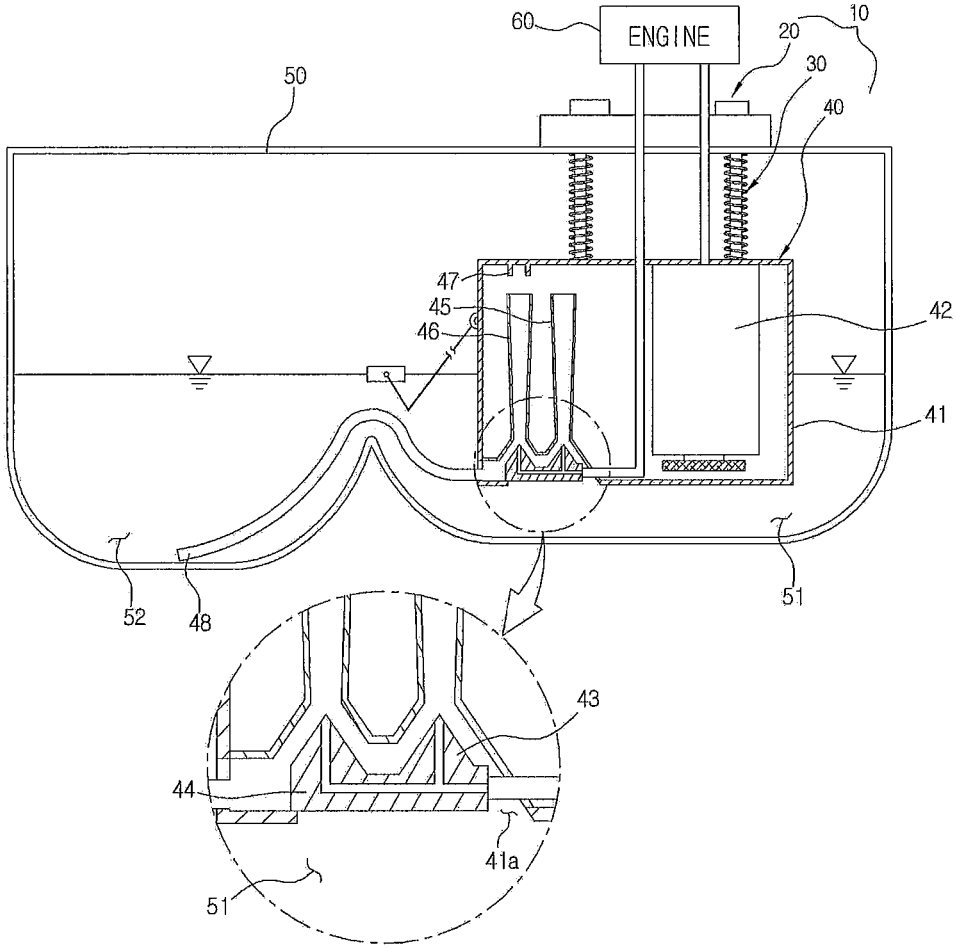
FIG. 1 Prior art
FIG. 1 is a schematic cross-sectional view showing a fuel pump module for a saddle type of fuel tank according to the related art.
Figure 2:
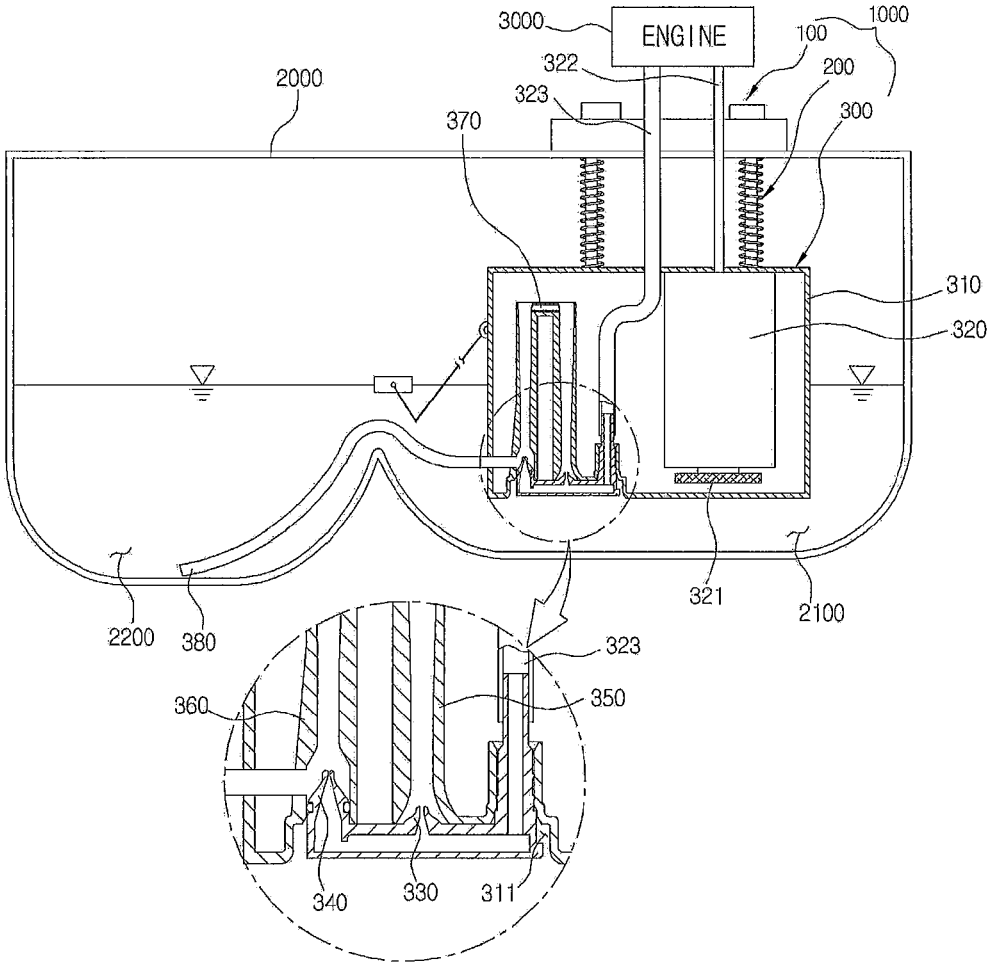
FIG. 2 is a schematic cross-sectional view showing a fuel pump module according to an exemplary embodiment of the present invention.

FIG. 2 is a schematic cross-sectional view showing a fuel pump module according to an exemplary embodiment of the present invention.

As shown, the fuel pump module 1000 according to the exemplary embodiment of the present invention is mounted in a first space part 2100 of a fuel tank 2000 in which the first space part 2100 and a second space part 2200 are formed.

In addition, the fuel pump module 1000 is mainly configured to include a flange assembly 100 and a reservoir body assembly 300, wherein the flange assembly 100 is fixed to an outer portion of an upper portion of the fuel tank 2000, and the reservoir body assembly 300 is fixed to a guide rod 200 extended from the flange assembly 100 and mounted in the fuel tank 2000.

Further, the reservoir body assembly 300 is positioned in the first space part 2100 of the fuel tank 2000 and has a suction tube 380 formed at one side thereof to be in communication with the second space part 2200, thereby making it possible to simultaneously suck fuel in the first space part 2100 and the second space part 2200.

Here, the reservoir body assembly 300 is configured to include: a reservoir body 310 having an introduction part 311 formed in a lower surface thereof so that fuel is introduced; a fuel pump 320 sucking the fuel in the reservoir body 310 to transmit the fuel to an engine 3000; a first jet 330 receiving a portion of the fuel transmitted from the fuel pump 320 or fuel returned from the engine 3000 to jet the received fuel upwardly and formed so that the fuel in the first space part 2100 of the fuel tank 2000 is sucked through the introduction part 311; a first jet tower 350 provided in the reservoir body 310, formed at an upper portion of the first jet 330, and communicating with the introduction part 311 to transmit the sucked fuel into the reservoir body 310; a second jet 340 receiving the returned fuel to jet the received fuel upwardly and formed so that the fuel in the second space part 2200 of the fuel tank 2000 is sucked through the suction tube 380; a second jet tower 360 provided in the reservoir body 310, formed at an upper portion of the second jet 340, and communicating with the suction tube 380 to transmit the sucked fuel into the reservoir body 310; and a connection tube 370 having both ends coupled to the first jet tower 350 and the second jet tower 360 to allow the first jet tower 350 and the second jet tower 360 to be in communication with each other.

Hereinafter, each component will be described in more detail.

Figure 3:
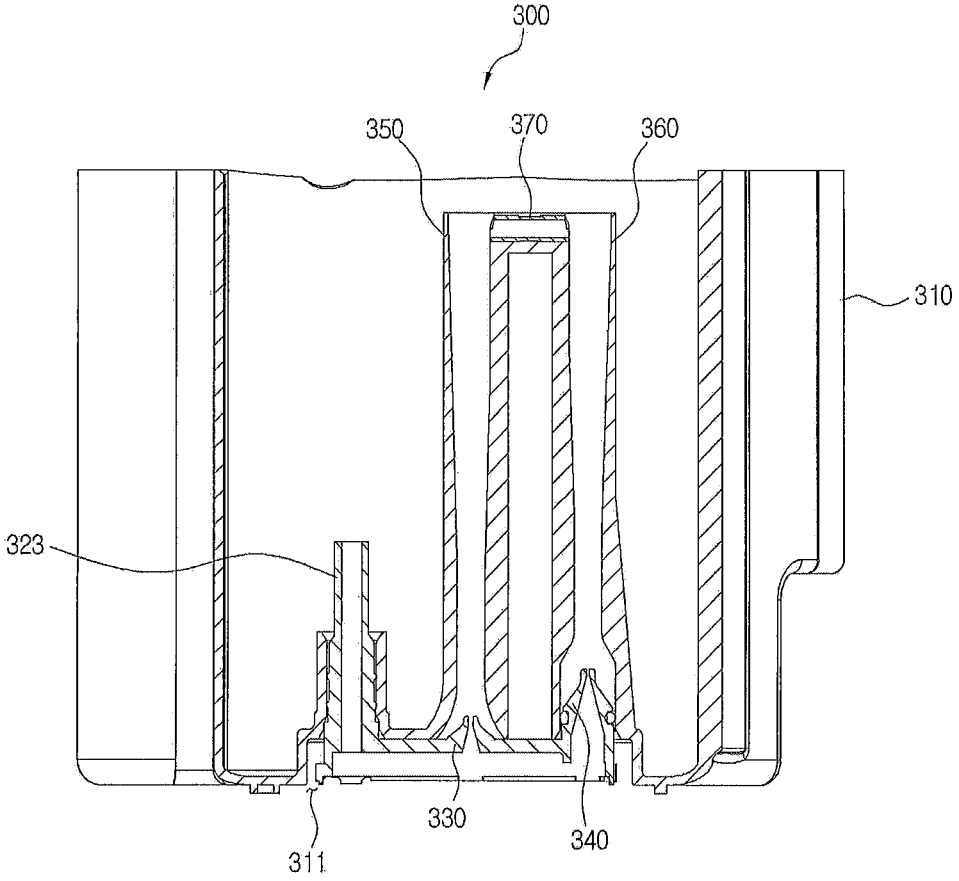
FIGS. 3 and 4 are, respectively, a cross-sectional view and a partially cross-sectional perspective view of a reservoir body assembly according to the exemplary embodiment of the present invention.
Figure 4:
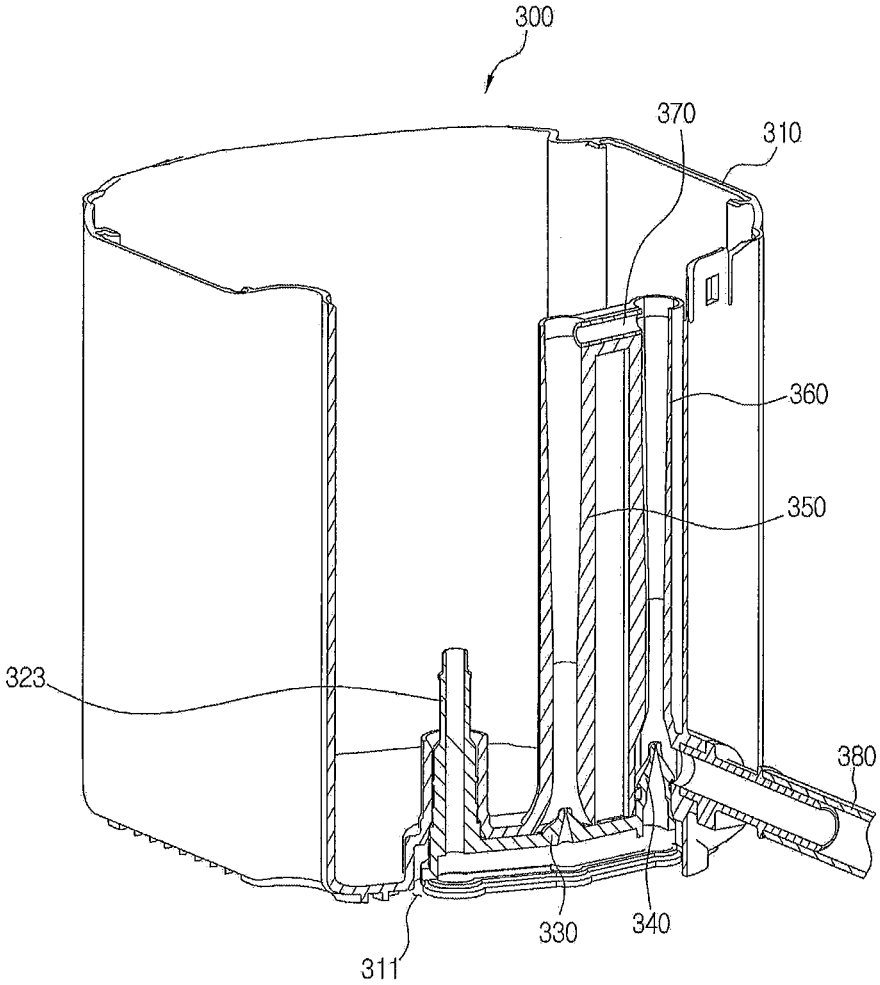

FIGS. 3 and 4 are, respectively, a cross-sectional view and a partially cross-sectional perspective view of a reservoir body assembly according to the exemplary embodiment of the present invention.

First, the reservoir body 310 is a storage formed in a container type in which it has an empty inner portion, seated and installed on a bottom surface of an inner portion of the fuel tank 2000, and having a predetermined amount of fuel filled therein, thereby making it possible to stably supply the fuel to the engine.

In addition, the reservoir body 310 has the introduction part 311 formed at a lower surface thereof so that the fuel is introduced.

In addition, the fuel pump 320 is provided in the reservoir body 310 to serve to suck the fuel filled in the reservoir body 310 to supply the sucked fuel to the engine 3000.

Here, the fuel pump 320 includes a suction part 321 formed at a lower portion thereof to suck the fuel in the reservoir body 310.

In addition, the fuel pump 320 includes a supply line 322 connected to an upper portion thereof, thereby making it possible to discharge the fuel to supply the discharged fuel to the engine 3000.

Further, the reservoir body 310 includes the first jet 330 and the second jet 340 formed at a lower portion of an inner portion thereof, wherein the first and second jets 330 and 340 receives a portion of the fuel transmitted from the fuel pump 320 and the fuel returned from the engine 3000 to jet the fuel upwardly, thereby allowing the fuel to be filled in the reservoir body 310.

Here, the jets 330 and 340 are connected to a return line 323 to be in communication with each other so that the fuel returned from the engine 3000 or a portion of the fuel transmitted from the fuel pump 320 is supplied.

In addition, each of the first and second jet towers 350 and 360 is formed at upper portions of the first and second jets 330 and 340 in a vertical direction, such that the fuel jetted from the first jet 330 and the second jet 340 is jetted upwardly along inner portions of the first and second jet towers 350 and 360.

Here, the jets 330 and 340 are formed in a nozzle type, such that the returned fuel is jet at a rapid speed, and the jet towers 350 and 360 are formed in a diffuser type to generate pressure drop around the jets 330 and 340, thereby allowing surrounding fuel to be sucked.

In more detail, the first jet 330 is formed at the introduction part 311 portion formed at the reservoir body 310, and the first jet tower 350 is formed at an upper portion of the first jet 330 and has a lower portion coupled to the introduction part 311 so as to be in communication with the introduction part 311, thereby making it possible to suck the fuel in the first space part 2100 of the fuel tank 2000.

In addition, the second jet 340 is formed at one side of the first jet 330 so as to be in parallel with the first jet 330, and the second jet tower 360 is formed at an upper portion of the second jet 340 and is coupled to the suction tube 380 so as to be in communication with the suction tube 380.

Here, an outer peripheral surface of the second jet 340 and an inner peripheral surface of the second jet tower 360 are coupled to each other so as to be sealed by a sealing member, such that introduction of the fuel through the introduction part 311 is blocked, and the suction tube 380 has one side positioned at the second space part 2200 of the fuel tank 2000 and the other side coupled to a lower side of the second jet tower 360 so as to be in communication with the lower side of the second jet tower 360, thereby making it possible to suck the fuel in the second space part 2200 of the fuel tank 2000.

As described above, the jets 330 and 340 and the jet towers 350 and 360 are formed so that the fuel in the first and second space parts 2100 and 2200 of the fuel tank 2000 may be simultaneously sucked, and the first and second jet towers 350 and 360 are formed in parallel with each other in the vertical direction so as to be spaced apart from each other by a predetermined distance. In this configuration, the connection tube 370 is formed to have both ends coupled to the first jet tower 350 and the second jet tower 360 to allow the first jet tower 350 and the second jet tower 360 to be in communication with each other.

That is, the connection tube 370 is a channel connecting to the first jet tower 350 and the second jet tower 360 to each other to allow the fuel to flow.

Hereinafter, an operation principle of the fuel pump module 1000 according to the exemplary embodiment of the present invention configured as described above and a flow of fuel will be described.

First, when the fuel is consumed due to an operation of the engine 3000 and the fuel pump module 1000, an oil surface of the fuel in the fuel tank 2000 becomes low at a specific height or less.

In this state, when the operation of the engine 3000 and the fuel pump module 1000 stops, the fuel filled in the reservoir body 310 is discharged to the first space part 2100 of the fuel tank 2000.

In addition, the fuel present in the first jet tower 350 is also discharged to the first space part 2100 through the introduction part 311, and the fuel in the second jet tower 360 is discharged to the second space part 2200 through the suction tube 380.

In this case, the inner portion of the first jet tower 350 always maintains a state in which the fuel remains at a predetermined height; however, a lower portion of the inner portion of the second jet tower 360 becomes a state in which all fuel is discharged and air is filled.

Figure 5:
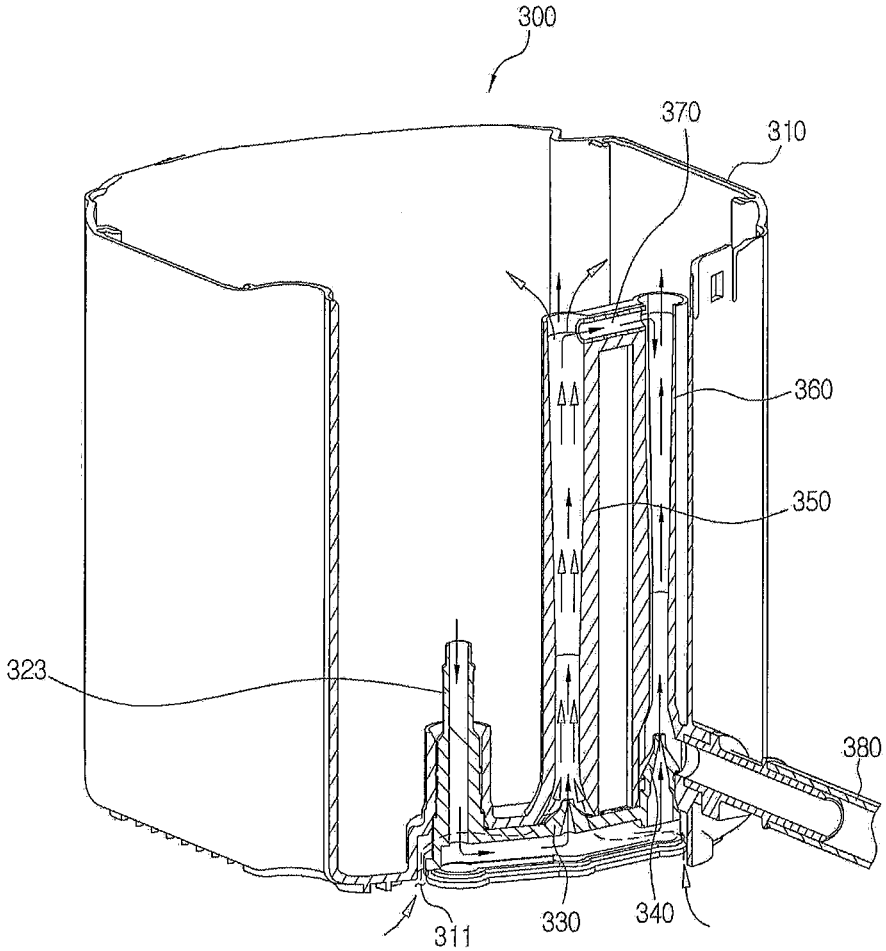
FIG. 5 is a schematic view showing a flow of fuel at the time of an initial operation of a fuel pump according to the exemplary embodiment of the present invention.

However, in this state, when the returned fuel is supplied to the first and second jets 330 and 340 to be jetted to each of the first and second jet towers 350 and 360, the fuel in the first space part 2100 is sucked along the introduction part 311 to be discharged into the reservoir body 310 while the fuel jetted from the first jet 330 flows upwardly along the first jet tower 350, as shown in FIG. 5.

Figure 7:
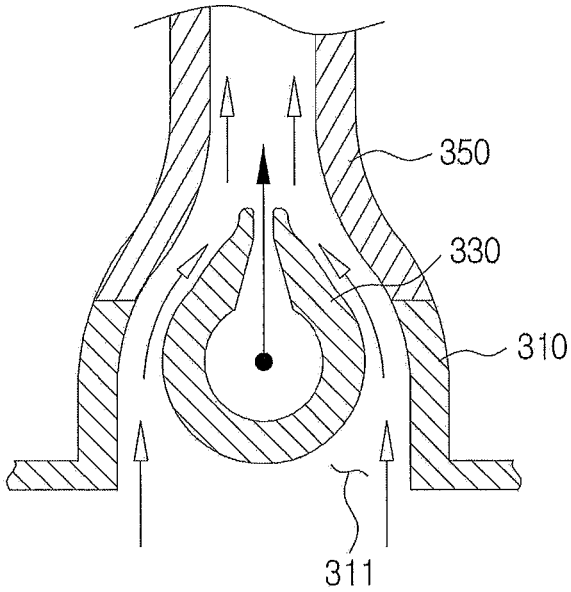
FIG. 7 is a right-side cross-sectional view showing a first jet part of FIG. 6.

That is, pressure drop is generated around the first jet 330 due to the fuel jetted from the first jet 330, and the fuel in the first space part 2100 is immediately sucked by surface tension of the fuel, as shown in FIG. 7.

On the other hand, the fuel jetted from the second jet 340 flows upwardly along the second jet tower 360 to be discharged into the reservoir body 310; however, a state in which the fuel in the second space part 2200 is not sucked is continued for a predetermined time.

That is, since air is filled in the lower portion of the inner portion of the second jet tower 360 and the suction tube 380, the fuel may not be sucked.

Figure 8:
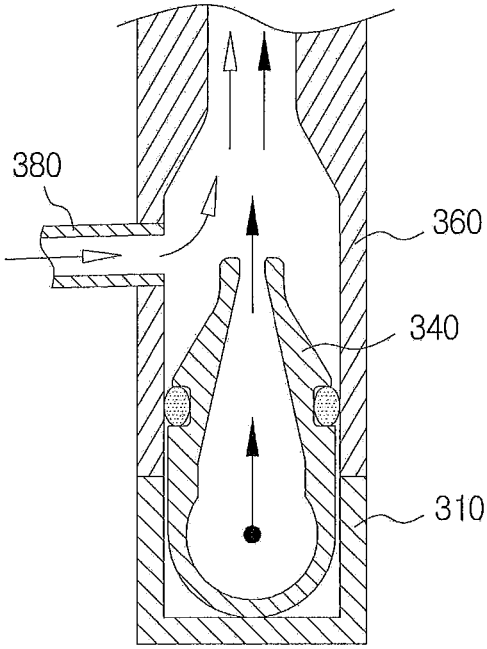
FIG. 8 is a right-side cross-sectional view showing a second jet part of FIG. 6.

In this case, a portion of the fuel jetted along the first jet tower 350 is introduced into the second jet tower 360 through the connection tube 370, such that the fuel is filled in the second jet tower 360. In addition, as shown in FIG. 8, the fuel jetted from the second jet 340 flows upwardly along the second jet tower 360, such that the pressure drop is generated around the second jet 340 due to the fuel jetted from the second jet 340 and the fuel in the second space part 2200 is sucked through the suction tube 380 by the surface tension of the fuel to be discharged into the reservoir body 310.

Figure 6:
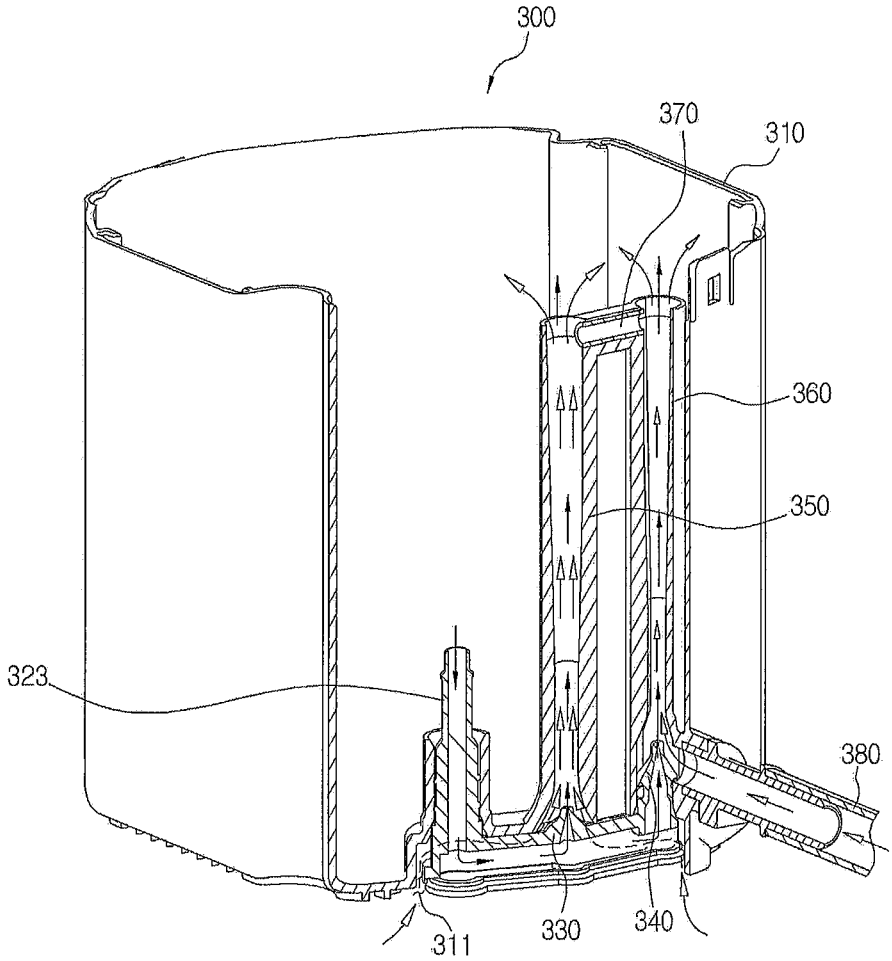
FIG. 6 is a schematic view showing a flow of fuel after the fuel pump according to the exemplary embodiment of the present invention operates for a predetermined time.

Therefore, as shown in FIG. 6, when the returned fuel is jetted from the first and second jets 330 and 340, the fuel passing through the first jet tower 350 is introduced toward the second jet tower 360 to be filled in the second jet tower 360, such that air is removed, thereby making it possible to rapidly suck the fuel in the second space part 2200 through the suction tube 380.

Therefore, the fuel in the first and second space parts of the fuel tank may be effectively sucked and used, such that the fuel may be stably supplied to the engine.

Figure 9:
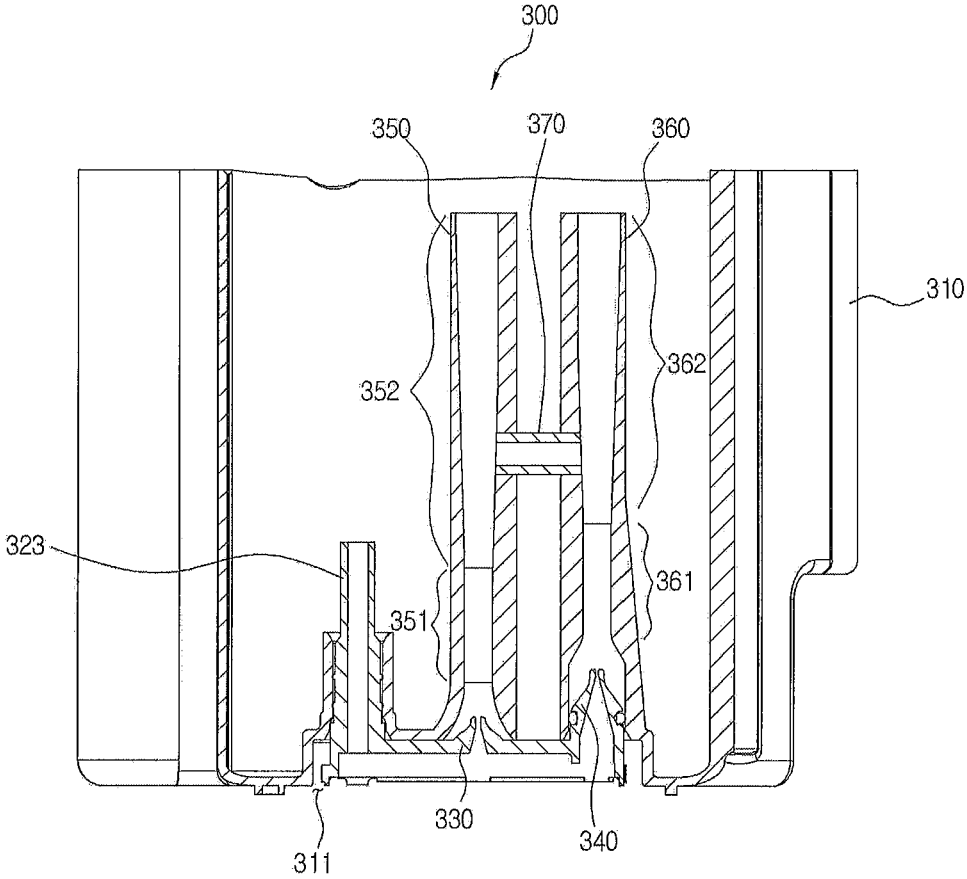
FIG. 9 is a schematic view showing different positions at which a connection tube according to the exemplary embodiment of the present invention is formed.

In addition, referring to FIG. 9, each of the first jet tower 350 and the second jet tower 360 may have a lower portion formed of straight pipe parts 351 and 361 and an upper portion formed of diffuser parts 352 and 362, and the connection tube 370 may be coupled to lower portions of the diffuser parts 352 and 362 to allow the diffuser parts 352 and 362 to be in communication with each other.

This is to reduce a distance at which the fuel flowing along the first jet tower 350 passes through the connection tube 370 and is then introduced into the second jet tower 360 while improving suction efficiency of the fuel through the introduction part and the suction tube 380 of the reservoir body to allow the fuel to be more rapidly filled in the second jet tower 360, thereby making it possible to efficiently suck the fuel in the fuel tank 2000.

Figure 10:
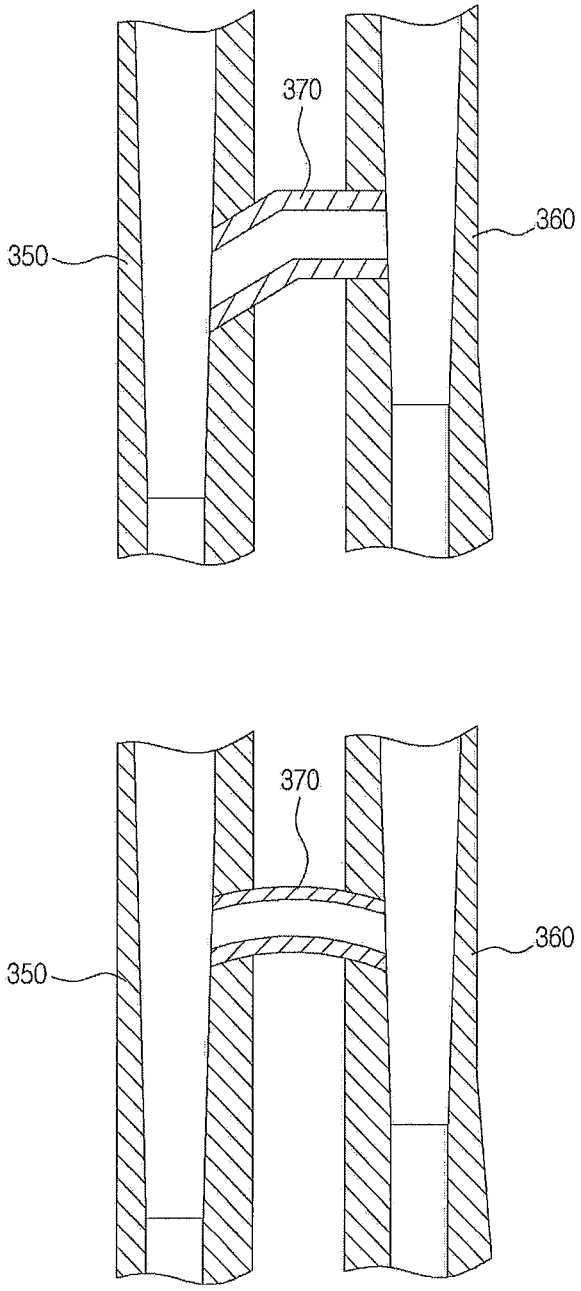
FIG. 10 is a schematic view showing a shape of the connection tube according to the exemplary embodiment of the present invention.

In addition, as shown in FIG. 10, one side of the connection tube 370 is formed in a tapered shape or a round shape, such that a portion of the fuel passing through the first jet tower 350 is easily introduced into the second jet tower 360, thereby making it possible to more rapidly fill the fuel in the second jet tower 360.

As set forth above, with the fuel pump module according to the exemplary embodiment of the present invention, when a portion of the fuel transmitted from the fuel pump provided in the reservoir or the fuel returned from the engine is supplied to the first jet and the second jet, a portion of the fuel is supplied from the first jet tower to the second jet tower through the connection tube connecting the first jet tower and the second jet tower to each other, such that the fuel is filled in the second jet tower to allow the fuel in the second space part of the fuel tank to be rapidly transmitted, thereby making it possible to stably supply the fuel to the engine.

In addition, each of the first jet tower and the second jet tower has a lower portion formed of straight pipe parts and an upper portion formed of diffuser parts, and the connection tube is coupled to lower portions of the diffuser parts to allow the diffuser parts to be in communication with each other, thereby making it possible to efficiently suck the fuel in the fuel tank 2000 while more rapidly filling the fuel in the second jet tower.

Further, one side of the connection tube is formed in a tapered shape or a round shape, such that a portion of the fuel passing through the first jet tower is easily introduced into the second jet tower, thereby making it possible to more rapidly fill the fuel in the second jet tower.

The present invention is not limited to the above-mentioned exemplary embodiments but may be variously applied, and may be variously modified by those skilled in the art to which the present invention pertains without departing from the gist of the present invention claimed in the claims.

What is claimed is:

1. A fuel pump module comprising:

a flange assembly mounted on a first space part of a fuel tank in which the first space part and a second space part are formed; and a reservoir body assembly connected to a lower portion of the flange assembly, wherein the reservoir body assembly includes:

a reservoir body having an introduction part formed in a lower surface thereof so that fuel is introduced;

a fuel pump sucking the fuel in the reservoir body to transmit the fuel to an engine;

a first jet receiving a portion of the fuel transmitted from the fuel pump or fuel returned from the engine to jet the received fuel upwardly and formed so that the fuel in the first space part of the fuel tank is sucked through the introduction part;

a first jet tower provided in the reservoir body, formed at an upper portion of the first jet and communicating with the introduction part to transmit the sucked fuel into the reservoir body;

a second jet receiving the returned fuel to jet the received fuel upwardly and formed so that the fuel in the second space part of the fuel tank is sucked through the suction tube;

a second jet tower provided in the reservoir body, formed at an upper portion of the second jet- and communicating with the suction tube to transmit the sucked fuel into the reservoir body; and a connection tube having both ends coupled to the first jet tower and the second jet tower to allow the first jet tower and the second jet tower to be in communication with each other, wherein one side of the connection tube is formed in a tapered shape or a round shape.

2. The fuel pump module of claim 1, wherein each of the first jet tower and the second jet tower has a lower portion formed of straight pipe parts and an upper portion formed of diffuser parts, and the connection tube is coupled to lower portions of the diffuser parts to allow the diffuser parts and to be in communication with each other.

* * * * *

UNITED STATES PATENT AND TRADEMARK OFFICE

CERTIFICATE OF CORRECTION

PATENT NO. : 8,820,350 B2
APPLICATION NO. : 13/542305
DATED : September 2, 2014
INVENTOR(S) : Joonseup Kim et al.

It is certified that error appears in the above-identified patent and that said Letters Patent is hereby corrected as shown below:

In the Claims

Column 8, Line 34, Claim 1, delete "jet" and insert -- jet, --

Column 8, Line 42, Claim 1, delete "jet-" and insert -- jet, --

Column 8, Line 56, Claim 2, before "to be" delete "and"

Signed and Sealed this
Thirtieth Day of December, 2014

Michelle K. Lee

Michelle K. Lee
*Deputy Director of the United States Patent and Trademark Office*